United States Patent [19]

Baren

[11] 3,955,683

[45] May 11, 1976

[54] LABORATORY RACK AND SHELF FOR FUNNEL-SHAPED GLASSWARE

[75] Inventor: Louis Baren, Chicago, Ill.

[73] Assignee: Accurate Wirecraft Company, Chicago, Ill.

[22] Filed: Nov. 29, 1974

[21] Appl. No.: 528,569

Related U.S. Application Data

[63] Continuation-in-part of Ser. No. 456,656, April 1, 1974.

[52] U.S. Cl. ..... 211/74; 23/292; 248/94; 248/311 A

[51] Int. Cl.[2] ..... B01L 9/00

[58] Field of Search ..... 248/94, 311, 312, 314, 248/315; 211/74, 181; 23/292

[56] References Cited

UNITED STATES PATENTS

| | | | |
|---|---|---|---|
| 541,457 | 6/1895 | Roscoe | 211/74 |
| 1,585,959 | 5/1926 | Avery | 211/74 X |
| 1,643,735 | 9/1927 | Baker | 211/74 |
| 2,562,443 | 7/1951 | Barbour et al. | 248/311 |
| 2,607,554 | 8/1952 | Charipar | 248/312 |
| 3,516,801 | 6/1970 | Shah | 248/311 X |
| 3,532,318 | 10/1970 | Lloyd | 248/311 |
| 3,752,651 | 8/1973 | Bush | 23/292 X |
| 3,858,835 | 1/1975 | Baren | 248/94 |

*Primary Examiner*—Roy D. Frazier
*Assistant Examiner*—Rodney H. Bonck
*Attorney, Agent, or Firm*—Alter and Weiss

[57] ABSTRACT

A wire frame shelf with longitudinally displaced conically-shaped, coaxial, funnel holders with an elongated vertical front clearance space on each funnel holder. The funnel holder is larger in the upper portion to receive and embrace a tapered glassware device in the axially displaced circumferential opening. A bight at the holder bottom formed by the crossing of the two U-shaped supports may act to support protuberances on some glassware devices and to protect protuberances on other glassware devices. Thus, the opening and bight provide a glassware device with a protuberance with horizontal support, vertical stability, protection from accidental jars, and a convenient resting place for the protuberance on the glassware device.

7 Claims, 5 Drawing Figures

LABORATORY RACK AND SHELF FOR FUNNEL-SHAPED GLASSWARE

This application is a Continuation-in-Part of my prior patent application Ser. No. 456,656 filed on Apr. 1, 1974.

This invention relates to racks, and more particularly to laboratory racks with support shelves, particularly shelves for funnel-shaped laboratory glassware with petcocks at their lower surface.

Laboratory glassware, in particular funnels or flasks with petcocks, are usually quite expensive, easily broken, and sometimes hard to handle. The nature of their use requires them to be handled in many different ways by many different people.

The clamps, shelves or racks which have been used in laboratories have required adjustments be made for each individual funnel or flask. Further, inadequately tightening the clamp or other holding device could easily cause the clamp holding the laboratory glassware device to fall and thus break the glass and necessitate a costly replacement. In addition to the forementioned problems there was also the problem of movement by the petcock and funnel, thus often causing failure and therefore constant repetition of experiments. All these difficulties caused laboratory workers to devote more time to adjusting clamps and shelves than to actual laboratory work.

Accordingly, an object of this invention is to provide a new and improved rack and shelf for laboratory glassware. In this connection a related object is to provide a rack which supports a shelf adapted for use with any different sized or type laboratory funnel with a petcock. The shelf is also adapted to support and protect a glassware protuberance of virtually any size and virtually any stem length.

Another object is to provide an assembled rack and shelf for funnels with petcocks and thereby eliminate the necessary clamp adjustment.

A further object is to provide an easily transportable rack and shelf. Here an object is to provide a rack with a shelf support which can be transported to any environment and yet withstand extremities in temperature, i.e., sterilization and refrigeration, will not absorb the temperature of the surrounding glass, and avoid damage from almost all laboratory-associated liquids.

Yet another object is to provide a shelf in which the petcock is supported, held stationary, easily reached, and therefore easily handled.

A further object is to provide a rack in which a series of funnels may be easily observed or easily hooked up to one another or other laboratory glassware.

Still another object is to provide a laboratory shelf in which funnels of different size are held, and thus will not move or tip over.

In keeping with an aspect of the invention, these and other objects are accomplished by an elongated wire frame shelf for laboratory glassware having on either side thereof longitudinally displaced conically-shaped, coaxial, funnel holders with an elongated vertical front clearance space on each funnel holder. The funnel holder is larger in the upper portion to receive and embrace in the axially displaced circumferential opening a tapered glassware device that cannot be conveniently vertically supported. The front clearance space on each funnel holder facilitates insertion or removal of the funnel-shaped glassware, and the bight formed at the slot bottom by the crossing of the two U-shaped supports acts to solidly support and protect the glassware protuberance, i.e., a petcock. Thus, the bight and opening provide horizontal support, vertical stability, protection, and a convenient resting place for the glassware device as well as the petcock on the glassware device.

The nature of a preferred embodiment will be understood best from a study of the attached drawings wherein.

Figure 1:
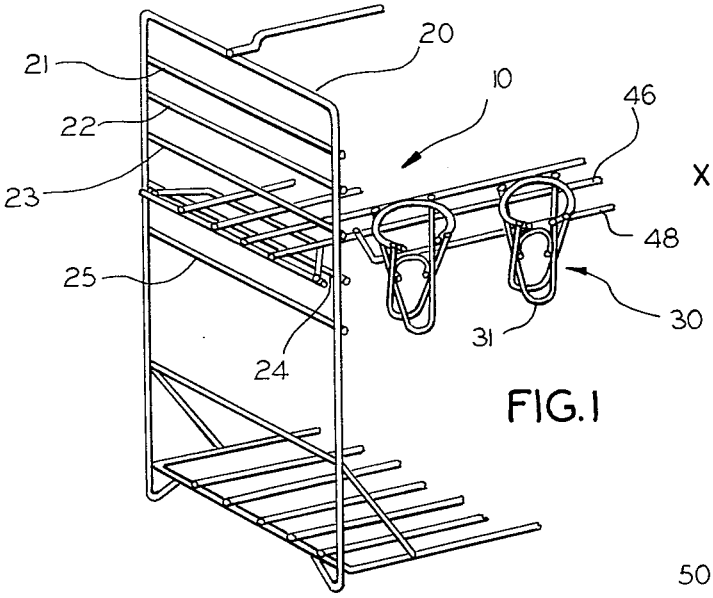
FIG. 1 is a schematic partial perspective view of a rack showing the funnel shelf incorporating the principles of the invention attached thereon.
Figure 2:
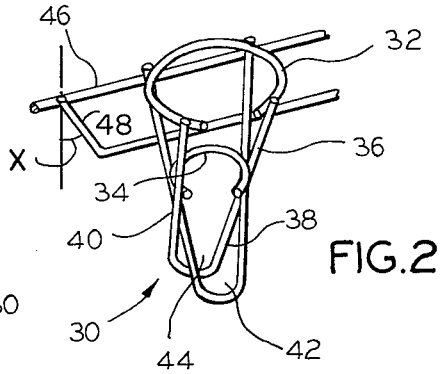
FIG. 2 is a perspective view of the inventive funnel holder.

By way of example, the rack and shelf of FIG. 1 is made primarily of spot welded heavy gauge steel wire covered by a neoprene rubber type material. The shelf 10 is disposed in stand 20 along horizontal members 21, 22, 23, 24 and 25. The shelf 10 may be placed on any convenient stand or support. The length and width of the shelf are flexible and may be supported in any convenient stand.

The shelf 10 includes a plurality of conical funnel holders 30 displaced longitudinally along each side thereof, the cone apex 31 extending below the shelf surface. Each of the conical funnel holders 30 has a pair of planar frame members 32, 34 disposed vertically at two points thereof in aligned spaced parallel relationship. By way of example, the members 32, 34 are shown as partically closed loops 32, 34 parallel to the shelf 10. The first loop 32 is located at the base of the conical-shaped holder, while the second loop 34 is located approximately one third the way down the funnel holder. The upper loop 32 is larger in size than the second loop 34. Two U-shaped supports 36, 38 external to the frame members 32, 34 slantingly extend downward from the upper loop 32. The first U-shaped support 36 is spot welded or otherwise attached to the front of the loops 32, 34. The second U-shaped support 38 is spot welded or otherwise attached at the rear of the loops 32, 34. The first and second U-shaped supports 36, 38 are placed in an inclined plane, and cross each other in an x-pattern at a point 40 approximately one third of the way upwards from bights 42, 44. The U-shaped supports 36, 38 are larger at the top portion, and taper downward to form the bights 42, 44 at the bottom thereof.

Horizontal rods 46, 48 act to support the second U-shaped support 38 at a proper inclined angle. Horizontal rod 48 is set at a predetermined angle x below the other horizontal rod 46 so that the U-shaped supports will cross at point 40 approximately one-third the way up from the bottom. Horizontal rod 48 extends downwardly from horizontal rod 46, and is spot welded to rod 46, the outermost horizontal rod. Further, the horizontal rods 46, 48 provide additional points to which U-shaped support 38 is spot welded. Thus, the second U-shaped support, the support upon which most of the weight is placed, is spot welded to both rings 32, 34 and two horizontal rods 46, 48.

Figure 3:
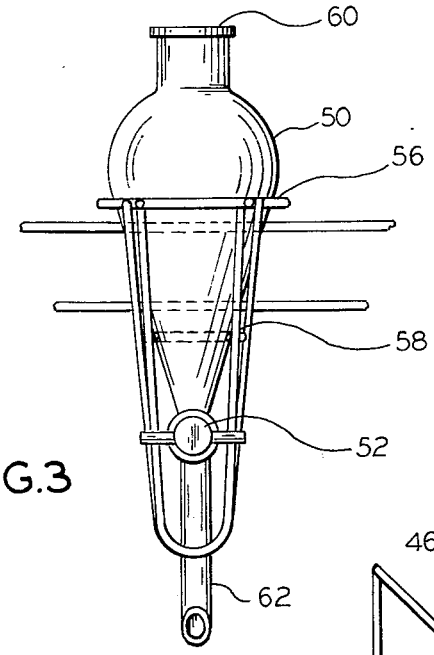
FIG. 3 is a front elevation view of the funnel holder with a funnel having a petcock protected therein.
Figure 4:
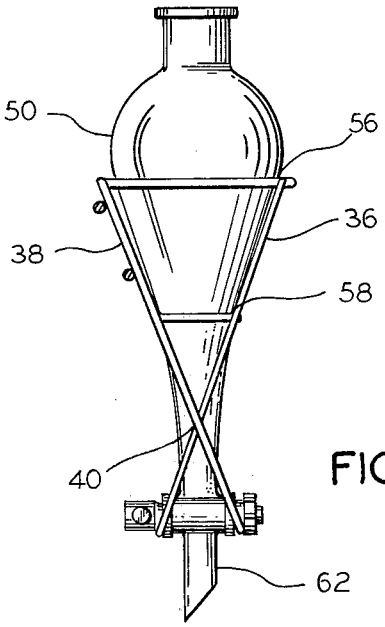
FIG. 4 is a side elevation view of the funnel holder with a funnel having a petcock supported therein.
Figure 5:
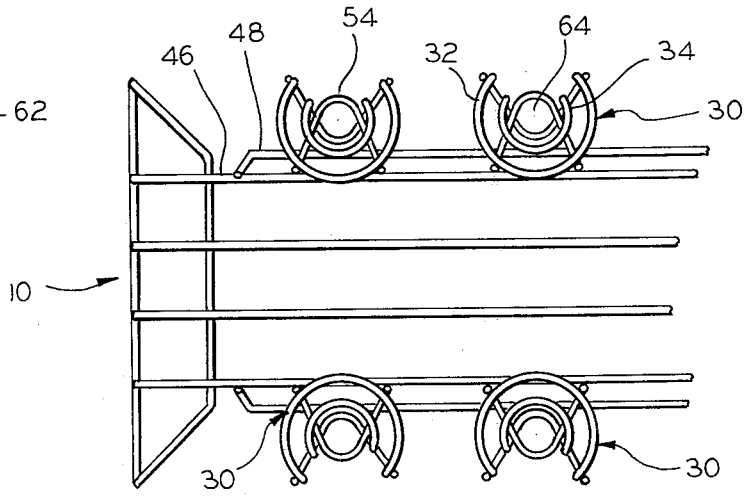
FIG. 5 is a plan view of the inventive shelf.

A tapered flask 50 with a tapered axial periphery and a protuberance 52 can be placed in the funnel holder 30. As seen in FIGS. 3 and 4 the protuberance or petcock 52 is faced toward the laboratory worker. After the tapered flask 50 is completely within the funnel holder 30, and supported by the loops 32, 34 at a top and central location, the petcock 52 should be resting within the bights 42, 44 of the U-shaped supports 36, 38. Depending upon the construction and dimensions of the particular funnel used, petcock 52 will be protectively suspended between U-shaped supports 36 and 38, or will be supported by bites 42 and 44. The tapered flask 50 nests in loops 32, 34 and the vertical axis of the flask always forms a right angle perpendicular to the horizontal axis, thereby insuring stability of the tapered flask.

Each funnel holder 30 has a clearance space 54 formed in the front. This allows the petcock 52 to slide down to the bights 42, 44 without encountering interference with supports or any other part which could lead to breakage.

In addition, the shelf 10 is provided with horizontal rods 46 and at least one additional rod 48 offset below and at an angle "X" from the upper rod 46. Thus, there is provided an additional support for the funnel glassware. With larger glassware funnels, loops 32, 34 and the additional rod 48 are used for support. With glassware of smaller size loop 34 is used and the additional rod 48.

The nature of the inventive concept may become apparent from a comparison of a prior art device with FIG. 4. With the prior art, a funnel-shaped glassware could be tipped over vertically. By providing the invention, a flask can be given stability and held vertically as shown in FIG. 4, rather than in the tipped position.

As shown in FIGS. 3 and 4 the loops 32, 34 and supports 36, 38 are shaped and proportioned to receive and embrace a tapered funnel shaped glassware object 50 nested in at least two axially displaced positions 56, 58. The petcock 52 may be nested in bight 42, 44 for support, or may be positioned between U-shaped supports 36, 38, thus limiting the distance by which spout 62 may be displaced. Thus, as the funnel nests in loops 32, 34 and U-shaped supports 36, 38 the vertical axis of the glassware funnel object 50 always forms a right angle perpendicular to the horizontal.

The crossing over of the two U-shaped supports 36, 38 provides means for evenly distributing and supporting the weight of the glassware funnel object. Further, the crossing over in such a pattern provides an opening 64 between the bights 42, 44 of the U-shaped supports 36, 38. This opening 64 only permits the tubular part 62 of the funnel 50 to enter, and there is no other movement possible, thus errors in experimentation are avoided.

There are many reasons why the vertical alignment is important. In the attaching of glass piping to the head 60 of the flask 50 a rigid attachment must be maintained. A slight deviation of the angular position of the flask 50 will cause excess stress and possible breakage of the glass pipes. However, with this invention, such a change of angularity is obviated. The flask 50 is securely held in a single vertical position.

The wire shelf, while made out of metal, is dipped in plastomer material, preferably neoprene rubber, to cover all sharp points and edges. This acts to prevent the lab worker from injury, and prevent damage to the glassware. The rubber covering further protects the shelf from damages due to laboratory chemicals.

While the principles of the invention have been described above in connection with specific apparatus and applications, it is to be understood that this description is made only by way of example and not as a limitation of the scope of the invention.

I claim:

1. A wire frame shelf for funnel shaped laboratory glassware with petcocks, comprising:

a plurality of horizontally displaced holders, each of said holders comprising at least two vertically disposed concentric partial rings, each of said partial rings being defined by a wire arcuate in configuration and terminating in spaced ends, said ends defining vertically aligned slots;

a pair of depending U-shaped supports, each of said U-shaped supports being formed of a pair of uprights spaced to define an opening therebetween, each of said pair of uprights joined at its lower end to the other of said pair to form a bight, the first of said pair of U-shaped supports having its uprights secured on opposite sides of said slots with said opening in alignment with said slots;

the second of said U-shaped supports having each of its uprights fastened to each said partial ring opposite from the first of said U-shaped support, said second of said U-shaped supports being further fastened to said shelf, said first of said U-shaped supports and said second of said U-shaped supports depending slantingly to cross at a predetermined position, said first of said U-shaped supports and said second of said U-shaped supports being fastened together at said predetermined position.

2. The apparatus as recited in claim 1 wherein said concentric partial rings are of different diameters, said rings being vertically arranged top to bottom in order of decreasing diameter, and the lowermost of said rings being positioned above said predetermined position.

3. The apparatus as recited in claim 1 wherein said shelf has horizontal rods extending therein, a single horizontal rod attached to and positioned outwardly and downwardly from the outermost of said horizontal rods, said single rod being attachment means for each said second of said U-shaped supports of each said holder.

4. The apparatus as recited in claim 1, wherein said bights formed on said pair of U-shaped supports define therebetween an opening, said opening being dimensioned to accommodate a tubular part lowermost on said funnel-shaped laboratory glassware.

5. The apparatus as recited in claim 1, wherein said first of said pair of U-shaped supports is fastened to said partial concentric rings and to said second of said U-shaped supports by spot welding, and said second of said pair of U-shaped supports is fastened to said concentric partial rings, said shelf and said first of said pair of U-shaped supports by spot welding.

6. The apparatus as recited in claim 1 wherein said U-shaped supports, together with said opening, are adapted nestlingly receive and embrace a funnel-shaped laboratory glassware with a petcock.

7. The apparatus as recited in claim 1, wherein said shelf and said holders are covered with plastic neoprene rubber material.

* * * * *